United States Patent [19]

Reas

[11] Patent Number: 4,821,748

[45] Date of Patent: Apr. 18, 1989

[54] HAND-HELD CIGARETTE-COLORING DEVICE

[76] Inventor: John H. Reas, 18125 Constitution Ave., Monte Sereno, Calif. 95030

[21] Appl. No.: 19,348

[22] Filed: Feb. 26, 1987

[51] Int. Cl.[4] ..... A24C 5/60; A24F 47/00

[52] U.S. Cl. ..... 131/329; 131/284; 401/9; 401/10; 401/11; 401/205

[58] Field of Search ..... 131/329, 284; 401/9, 401/10, 11, 205; 400/124, 202.2, 202.3, 202.4

[56] References Cited

U.S. PATENT DOCUMENTS

| | | | |
|---|---|---|---|
| 2,408,481 | 10/1946 | Reid | 401/11 |
| 2,743,470 | 5/1956 | Horowitz | 401/205 |
| 4,400,102 | 8/1983 | Shiurila et al. | 400/124 |

*Primary Examiner*—V. Millin

*Attorney, Agent, or Firm*—John J. Leavitt

[57] ABSTRACT

A hand-held cigarette-coloring device that transfers a liquid pigment onto the external paper of cigarettes as the cigarettes are passed through the device.

9 Claims, 1 Drawing Sheet

HAND-HELD CIGARETTE-COLORING DEVICE

BACKGROUND OF THE INVENTION

1. Field of the Invention

This invention relates to a device that colors cigarettes, and particularly to a hand-held device that colors cigarettes by transferring a liquid pigment onto the external paper of the cigarette as the cigarette is passed through the coloring device.

2. Description of the Prior Art

To my knowledge, people who smoke cigarettes have no choice concerning the color of the cigarettes that they smoke. A search for prior art regarding or relating to a hand-held cigarette-coloring device has revealed no patents in this subject area.

The primary objects and advantages of the invention include the following:

To provide a hand-held cigarette-coloring device for use by cigarette smokers,.

To provide such a device that is quick and easy to operate.

To provide such a device that is small, lightweight and convenient to carry.

To provide such a device that is durable, non-breakable and non-spillable.

To provide such a device that has no service requirement whatsoever so that the device can be simply discarded after the ink is exhausted.

To provide such a device that is inexpensive and exciting to use.

To provide such a device that is modular for assembly with other identical units each of which can hold a different liquid pigment so that many coloring choices can be made by the user.

To provide such a device whose inking pigments are non-toxic, non-flammable and have no ordor or taste.

To provide such a device whose usage does not alter the normal burning characteristics of the cigarette.

Further objects and advantages of the invention will become apprent from a consideration of the ensuing description and the accompanying drawings. It is to be understood however that the invention is not limited to the embodiment illustrated and described, since it may be embodied in various forms within the scope of the appended claims.

SUMMARY OF THE INVENTION

Cigarette smokers will find it desirable to have a hand-held device for coloring cigarettes so that plain white cigarettes can be altered to any color or colors, or color pattern specifically chosen by themselves. This cigarette-coloring device allows cigarette smokers the ability to display colorful cigarettes representative of their own individualistic sense of style and flair as they smoke.

In terms of broad inclusion, the device comprises a housing within which is provided a reservoir for ink and a wick having an aperture through which a cigarette may be drawn. As the cigarette passes through the apertured wick, a pigmented fluid is transferred to the paper containing the cigarette tobacco. A cover is provided to close and seal the housing when not in use.

BRIEF DESCRIPTION OF THE DRAWING

FIGS. 1 to 6 show an exploded view of the hand-held cigarette-coloring device, in which:

FIG. 1 is a perspective view of the housing member.

FIG. 2 is a perspective view of the ink reservoir.

FIG. 4 is a perspective view of a cigarette-aligning guide.

FIG. 5 is a perspective view of a cigarette-aligning guide seal.

FIG. 6 is a perspective view of the housing cap.

DESCRIPTION OF THE PREFERRED EMBODIMENT

Figure 2:
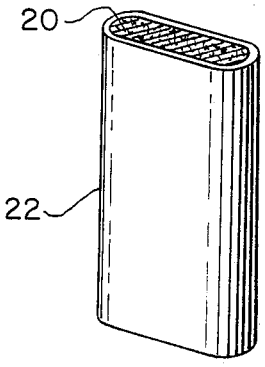
Figure 1:
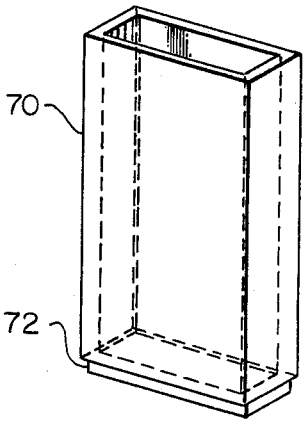
Figure 7:
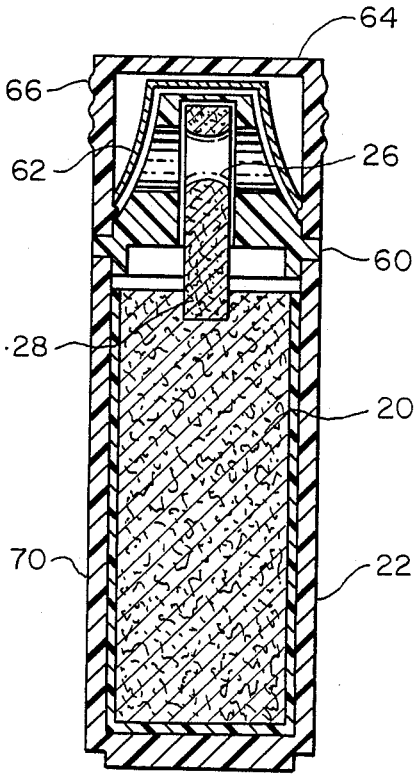
FIG. 7 is a cross-sectional view of the assembled cigarette-coloring device with FIG. 3A as the inking element or wick.

FIG. 1 shows the cigarette-coloring housing member. The housing member 70 is a unitary rectangular hollow member measuring about 5 by 2 by 1 cm. It is fabricated from liquid-impervious plastic on all sides except for the opening at the top. The housing member thus forms a cavity that accomodates the ink reservoir (FIG. 2). The bottom perimeter of the housing has a ridge 72 that temporarily accomodates the housing cap (FIG. 6) when the device is in use.

FIG. 2 shows the ink reservoir. The ink reservoir is comprised of many ink-holding fibers 20 saturated with a coloring liquid or pigment that is non-toxic, non-flammable and has no order or taste. These fibers are wrapped together to form a bundle by a thin plastic seal 22 on all sides except for the top of the ink reservoir. The ink reservoir has dimensions complementary to the housing cavity element (FIG. 1) so that the ink reservoir fits snugly into the housing cavity.

Figure 3A:
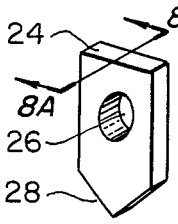
FIG. 3A is a perspective view of a continuous inking element or wick with a rigid inking surface.

FIG. 3A shows a porous, absorbent inking element or felt-like wick with a continuous inking surface 26. The main body of the inking element is rigid. The inking element has a tapered bottom 28 that is in contact with the fibers 20 of the ink reservoir (FIG. 2). The aperture of the inking element has an innermost diameter that is the same as that of a cigarette's diameter. The inking surface 26 is convex so that friction between the cigarette paper and the inking surface is minimized. The top of the inking element and the position of the inking surface are designed to match the configuration of the cigarette-aligning guide (FIG. 4) such that the top of the inking element 24 is stable and secure within the top portion of the guide 56 and also so that the center of the inking surface is aligned with the aperture 58 of the guide.

Figure 3B:
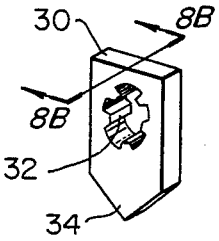
FIG. 3B is a perspective view of a discontinuous inking element or wick.

FIG. 3B shows another porous, absorbent inking element or felt-like wick but with a discontinuous inking surface 32. The main body of the inking element 30 is rigid as before. The inking element has a tapered bottom 34 that is in contact with the fibers 20 of the ink reservoir (FIG. 2). The discontinuous inking surface 32 has been apertured to provide segmented lands and grooves so that a discontinuous inking surface results. This inking element has the diameter of the lands being dimensioned slightly larger than a cigarette's 1.0 cm. diameter so that random and intermittent contact will be made between the cigarette and the inking surface. Again, the top of the inking element and the position of the inking surface is designed to match the configuration of the cigarette-aligning guide (FIG. 4) such that the top of the inking element is stable and secure in the top portion of the guide and also so that the center of the inking surface is aligned with the aperture 58 of the guide.

Figure 3C:
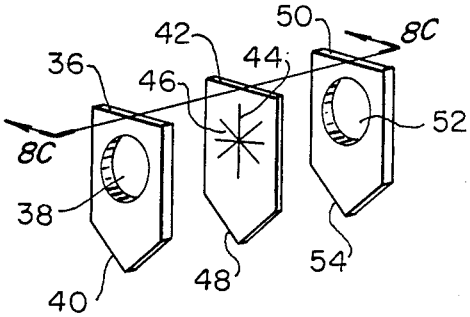
FIG. 3C is a perspective view of a continuous inking element or wick with a flexible inking surface.

FIG. 3C shows an exploded view of another porous, absorbent inking element or felt-like wick with a continuous inking surface 46. The main body of the inking element is rigid. The inking element has a tapered bottom 40, 48 and 54 that is in contact with the fibers 20 of the ink reservoir (FIG. 2). The continuous inking surface 46 has been cut through by a multiplicity of radially extending slits 44 such that a series of circularly arranged flaps 46 are formed free at their apices but joined to the main body at their bases whereby the flaps may be displaced out of planar alignment to form an aperture slightly larger than the 1.0 cm. diameter of a cigarette. This inking surface formed by flaps is flexible and the flaps can bend back and forth upon application of external force. The inking element is comprised of three members 36, 42 and 50 so that the inking flaps 46 have minimal frictional contact with the cigarette paper as the cigarette is passed through the inking element. The two bordering members 36 and 50 have apertures whose diameters are slightly larger than that of the inking surface 46. Again, the top of the inking element and the position of the inking surface are designed to match the configuration of the cigarette-aligning guide (FIG. 4) such that the top of the inking element is stable and secure in the top portion of the guide and also so that the center of the inking surface is aligned with the aperture 58 of the guide.

Figure 4:
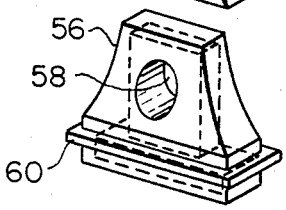
Figure 8A:
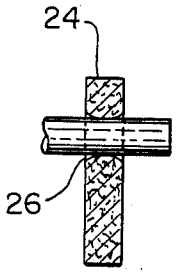
FIG. 8A is a cross-sectional view of a continuous inking element or wick with a rigid inking surface in contact with a cigarette as the cigarette is being passed over the inking surface.
Figure 8B:
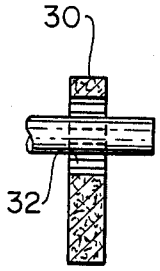
FIG. 8B is a cross-sectional view of a discontinuous inking element or wick in contact with a cigarette as the cigarette is being passed over the inking surface.
Figure 8C:
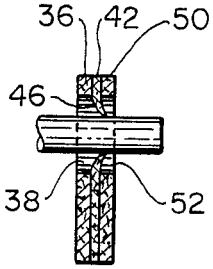
FIG. 8C is a cross-sectional view of a continuous inking element or wick with a flexible inking surface in contact with a cigarette as the cigarette is being passed over the inking surface.

FIG. 4 shows the cigarette-aligning guide. The guide 56 is fabricated from liquid-impervious plastic. The dimensions of the bottom of the guide matches the dimensions of the top perimeter of the housing unit (FIG. 1) so that the sealing ridge 60 fits snugly onto the housing unit. Together with the housing unit, the cigarette-aligning guide fully encloses both the ink reservoir and the inking element except for the inking surface 26, 32 or 46 which is exposed via the aperture 58 of the guide when the device is in use. The aperture has a diameter slightly larger than cigarette's diameter of 1.0 cm. and the aperture is designed to be in alignment with the inking surface 26, 32 or 46 of the inking element as the inking element is positioned in the interior of the guide.

Figure 5:
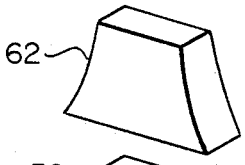

FIG. 5 shows the cigarette guide seal. The seal 62 fits snugly into the interior of the housing cap (FIG. 6) held in place by an inner ridge 68 of the housing cap that supports the bottom perimeter of the seal. The guide seal is plastic and has an internal cavity of such form that corresponds to the exterior form of the cigarette guide 56 such that a sealing occurs when the housing cap is placed onto the guide (FIG. 4) and housing element (FIG. 1).

Figure 6:
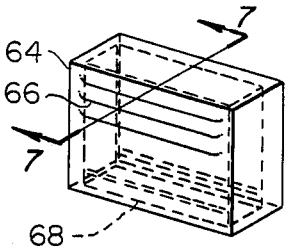

FIG. 6 shows the housing cap. The housing cap 65 has an inner ridge 68 that supports the bottom perimeter of the seal (FIG. 5) so that the seal is held securely in the interior of the housing cap. The housing cap has external finger-grips 66 in the form of integral ridges for ease of use by the user. The bottom open end of the cap fits snugly on the top of the ridge of the cigarette guide 60 to close the housing or onto the bottom ridge of the housing unit 72 when the deive is in use.

The cigarette-coloring device operates by having a reservoir of colored ink (FIG. 2) that is in physical contact with a porous, absorbent inking element (FIG. 3A, 3B or 3C) that functions like a wick which transfers the ink onto the cigarette paper as the cigarette is passed through or over the inking surface 26, 32 or 46. After some ink has been transferred by contact between the cigarette paper and the inking element surface, the porous inking element draws ink via absorption from the ink reservoir. This process is repeated until the fibers of the ink reservoir have been depleted of ink.

The inking elements may have different contact surface configurations so that different coloring patterns or designs can be achieved by the user. FIG. 3A shows an inking element that has an aperture with a convex inking surface 26 that inks the cigarette paper continuously as the cigarette is passed through the inking element. FIG. 3B another inking element that has an aperture with a discontinuous inking surface 32 so that its contact surface inks the cigarette paper radomly and intermittently as the cigarette is pushed or drawn past the inking surface so that a speckled, dappled or striped coloring design can be achieved. FIG. 3C shows another inking element that has an aperture formed by juxtaposed triangular flaps 46 that bend back over and about the cigarette as the cigarette is pushed or drawn through the inking element so that solid, continuous inking occurs on the cigarette paper.

To use the cigarette-coloring device, the user first pulls the housing cap via the finger-grips 66 off the top of the housing element so that the cigarette-aligning guide 56 is exposed. The cap can be temporarily secured onto the mating ridge 72 on the bottom of the housing element. the user then inserts either end of the cigarette into the aperture 58 of the cigarette-aligning guide and pushes the cigarette through to the other side of the guide. It will be found that pigment has been applied to the cigarette paper. To obtain different coloring patterns, the user can partially pass the cigarette through the guide and then return it to the original entrance side. Also, the user can rotate or bounce the cigarette over the discontinuous inking surface 32 for a striped, speckled or discontinuous inking pattern. After the user is finished inking the cigarette, the user simply pulls the cap 64 off the bottom of the housing element 70 and replaces it back on top of the guide. This will seal the guide and its internal inking elements by the snug fitting seal 62 contained inside the housing cap.

While the above description is specific to a particular embodiment, it will be obvious that other embodiments may be made within the scope of the appended claims.

For the purposes of this diclosure, ink is considered to be equivalent to liquid pigment.

I claim:

1. A hand-held cigarette-coloring device, comprising:

(a) an reservoir adapted to contain inking fluids; and (b) an apertured porous ink-absorbent inking element for drawing ink from said reservoir and wherein said aperture is dimensioned to receive a cigarette whereby ink from said inking element is transferred onto the external surface of a cigarette caused to be passed through the aperture in the ink-absorbent inking element.

2. The combination according to claim 1, in which the surface of said inking element defining said non-rectangular aperture is circularly continuous.

3. The combination according to claim 1, in which the surface of said inking element defining said non-rectangular aperture is provided with grooves defining lands forming a discontinuous inking surface on the inner periphery of the aperture.

4. The combination according to claim 1, in which the inking surface defining said non-rectangular aperture is formed by flexible juxtaposed flaps adapted to bend back over and about a cigarette caused to be passed through the inking element.

5. The combination according to claims 1, 2, 3 or 4, in which a housing including a cap sealingly encloses said reservoir and said inking element when not in use to seal the device against the spilling of ink.

6. The combination according to claim 5, in which said cap provided on said housing is selectively removable to expose said non-rectangularly apertured inking element for use.

7. The combination according to claim 1, in which an apertured cigarette-aligning guide is provided operatively associated with said non-rectangularly apertured absorbent inking element.

8. The combination according to claim 7, in which seal means are provided selectively attachable or detachable from said cigarette-aligning guide to selectively cover or uncover the aperture therein.

9. The method of coloring a cigarette comprising the steps of:

(a) saturating an absorbent apertured element with a selected color of ink; and (b) passing a cigarette through the aperture in wetting contact with the absorbent element.

* * * * *